US007932491B2

(12) United States Patent
Vestal

(10) Patent No.: US 7,932,491 B2
(45) Date of Patent: Apr. 26, 2011

(54) QUANTITATIVE MEASUREMENT OF ISOTOPE RATIOS BY TIME-OF-FLIGHT MASS SPECTROMETRY

(75) Inventor: Marvin L. Vestal, Framingham, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 337 days.

(21) Appl. No.: 12/365,354

(22) Filed: Feb. 4, 2009

(65) Prior Publication Data

US 2010/0193681 A1 Aug. 5, 2010

(51) Int. Cl.
*H01J 49/00* (2006.01)

(52) U.S. Cl. ..... 250/287; 250/281; 250/282; 250/283; 250/286; 250/288; 250/396 R; 250/396 ML

(58) Field of Classification Search ..... 250/281–283, 250/286–288, 396 R, 396 ML
See application file for complete search history.

(56) References Cited

U.S. PATENT DOCUMENTS

| | | | | |
|---|---|---|---|---|
| 5,144,127 | A | 9/1992 | Williams et al. | |
| 5,160,840 | A | 11/1992 | Vestal | |
| 5,166,518 | A | 11/1992 | Freedman | |
| 5,625,184 | A | 4/1997 | Vestal et al. | |
| 5,627,369 | A | 5/1997 | Vestal et al. | |
| 5,847,385 | A | 12/1998 | Dresch | |
| 6,057,543 | A | 5/2000 | Vestal et al. | |
| 7,223,966 | B2 | 5/2007 | Weiss et al. | |
| 2003/0141447 | A1 | 7/2003 | Verentchikov et al. | |
| 2005/0269505 | A1 | 12/2005 | Ermer | |
| 2005/0279933 | A1 | 12/2005 | Appelhans et al. | |
| 2008/0272290 | A1 * | 11/2008 | Vestal | 250/287 |
| 2008/0272293 | A1 * | 11/2008 | Vestal | 250/288 |

OTHER PUBLICATIONS

"Notification Concerning Transmittal Of International Preliminary Report On Patentability (Chapter I Of The Patent Cooperation Treaty)" For PCT/US2009/045108, Dec. 9, 2010, 9 pages, The International Bureau Of WIPO, Geneva, Switzerland.

"Notification Of Transmittal Of The International Search Report And The Written Opinion Of The International Searching Authority, Or The Declaration" For PCT/US2010/022122, Aug. 16, 2010, 9 pages, International Searching Authority, Korean Intellectual Property Office, Seo-gu, Daejeon, Republic of Korea.

Beavis, Ronald C., et al., Factors Affecting The Ultraviolet Laser Desorption Of Properties, Rapid Communications In Mass Spectrometry, 1989, pp. 233-237, vol. 3, No. 9, Heyden & Son Limited.

(Continued)

*Primary Examiner* — Robert Kim
*Assistant Examiner* — Meenakshi S Sahu
(74) *Attorney, Agent, or Firm* — Kurt Rauschenbach; Rauschenbach Patent Law Group, LLP

(57) ABSTRACT

A mass spectrometer includes a pulsed ion source that generates an ion beam comprising a plurality of ions. A first timed ion selector passes a first group of ions. A first ion mirror generates a reflected ion beam comprising the first group of ions that at least partially compensates for an initial kinetic energy distribution of the first group of ions. A second timed ion selector passes a second group of ions. A second ion mirror generates a reflected ion beam comprising the second group of ions that at least partially compensates for an initial kinetic energy distribution of the second group of ions. A timed ion deflector deflects the second group of ions to a detector assembly comprising at least two ion detectors which detects the deflected ion beam.

34 Claims, 12 Drawing Sheets

OTHER PUBLICATIONS

Bergmann, T., et al., High-Resolution Time-Of-Flight Mass Spectrometer, Rev. Sci. Instrum., Apr. 1989, pp. 792-793, vol. 60, No. 4, American Institute Of Physics.
Beussman, Douglas J., et al., Tandem Reflectron Time-Of-Flight Mass Spectrometer Utilizing Photodissociation, Analytical Chemistry, Nov. 1, 1995, pp. 3952-3957, vol. 67, No. 21, American Chemical Society.
Colby, Steven M., et al., Space-Velocity Correlation Focusing, Analytical Chemistry, Apr. 15, 1996, pp. 1419-1428, vol. 68, No. 8, American Chemical Society.
Cornish, Timothy J., et al., A Curved Field Reflectron Time-Of-Flight Mass Spectrometer For The Simultaneous Focusing Of Metastable Product Ions, Rapid Communication In Mass Spectrometry, 1994, pp. 781-785, John Wiley & Sons.
Cornish, Timothy J., et al., Tandem Time-Of-Flight Mass Spectrometer, Analytical Chemistry, Apr. 15, 1993, pp. 1043-1047, vol. 65, No. 8.
Hillenkamp, F., Laser Desorption Mass Spectrometry: Mechanisms, Techniques And Applications, 1989, pp. 354-362, vol. 11A, Heyden & Son, London.
Kaufmann, R., et al., Mass Spectrometric Sequencing Of Linear Peptides By Product-Ion Analysis In A Reflectron Time-Of-Flight Mass Spectrometer Using Matrix-Assisted Laser Desorption Ionization, Rapid Communications In Mass Spectrometry, 1993, pp. 902-910, vol. 7, John Wiley & Sons, Ltd.
Mamyrin, B.A., et al., The Mass-Reflectron, A New Nonmagnetic Time-Of-Flight Mass Spectrometer With High Resolution, Sov. Phys. 1973, pp. 45-48, Vo. 37, No. 1, American Institute of Physics.
Matsuda, H., et al., Particle Flight Times Through Electrostatic And Magnetic Sector Fields And Quadrupoles To Second Order, International Journal Of Mass Spectrometry And Ion Physics, 1982, pp. 157-168, vol. 42, Elsevier Scientific Publishing Company, Amsterdam, The Netherlands.
Neuser, H. J., et al., High-Resolution Laser Mass Spectrometry, International Journal Of Mass Spectrometry And Ion Process, 1984, pp. 147-156, vol. 60, Elsevier Science Publishers B.V., Amsterdam, The Netherlands.
Vestal, M. L., et al., Delayed Extraction Matrix-Assisted Laser Desorption Time-Of-Flight Mass Spectrometry, Rapid Communications In Mass Spectrometry, 1995, pp. 1044-1050, vol. 9, John Wiley & Sons, Ltd.
Vestal, M. L., et al., Resolution And Mass Accuracy In Matrix-Assisted Laser Desorption Ionization-Time-of-Flight, American Society For Mass Spectrometry, 1998, pp. 892-911, Elsevier Science Inc.
Vestal, M., High Performance MALDI-TOF Mass Spectrometry For Proteomics, International Journal Of Mass Spectrometry, 2007, pp. 83-92.
Wiley, W. C., et al., Time-Of-Flight Mass Spectrometer With Improved Resolution, The Review Of Scientific Instruments, Dec. 1955, pp. 1150-1157, vol. 26, No. 13.
Zhou, J., Kinetic Energy Measurements Of Molecular Ions Ejected Into An Electric Field By Matrix-Assisted Laser Desorption, Rapid Communications In Mass Spectrometry, Sep. 1992, pp. 671-678, vol. 6, John Wiley & Sons, Ltd.

* cited by examiner

500

Table I

| Selector | $D_e$(mm) | $d_4$(mm) | $m_0$(Da) | ΔD(mm)/Da | V(kV) | $v_n$(mm/ns) | $t_0$(ns) | Δt(ns)/Da |
|---|---|---|---|---|---|---|---|---|
| 1 | 265 | 1000 | 100 | 1.3 | 8 | 0.125 | 2120 | 10.6 |
| | | | | | 0.9 | 0.042 | 6360 | 31.8 |
| | | | 14 | 9.5 | 8 | 0.334 | 793 | 28.3 |
| | | | | | 0.9 | 0.111 | 2379 | 85.0 |
| 2 | 2650 | 2400 | 100 | 13 | 8 | 0.125 | 21200 | 106 |
| | | | | | 0.9 | 0.042 | 63600 | 318 |
| | | | 14 | 95 | 8 | 0.334 | 7930 | 283 |
| | | | | | 0.9 | 0.111 | 23790 | 850 |

FIG. 5

900

Table I. Masses of ions potentially interfering with $^{41}CaF^{+}$.

| Ion | mass(da) | RP Req'd | Rel. Ab. (%) | Ion | mass(da) | RP Req'd | Rel. Ab. (%) |
|---|---|---|---|---|---|---|---|
| $^{41}CaF^{+}$ | 59.96013 | ref | $<10^{-13}$ | $Na^{37}Cl^{+}$ | 59.95512 | 11,973* | 24.23 |
| $^{41}KF^{+}$ | 59.95968 | 133,000* | 6.73 | $^{58}FeH_2^{+}$ | 59.94838 | 5,100 | 0.28 |
| $^{60}Ni^{+}$ | 59.93023 | 2,005 | 26.1 | $^{32}SC_2H_4^{+}$ | 60.00282 | 1,405 | 95.02 |
| $C_2O_2H_4^{+}$ | 60.02058 | 992 | 98. | $^{31}PC_2H_5^{+}$ | 60.01234 | 1,148 | 100. |
| $^{59}CoH^{+}$ | 59.94047 | 3,050 | 100. | $^{28}SiO_2^{+}$ | 59.96621 | 9,865 | 92.23 |

*not expected to be stable under laser desorption conditions

FIG. 9A

950

Table II. Mass of ions potentially interfering with $^{41}CaF_3^-$ and $^{46}CaF_3^-$.

| Ion | mass (da) | RP Req'd | Ion | mass (da) | RP Req'd |
|---|---|---|---|---|---|
| $^{41}CaF_3^-$ | 97.958 | ref | $^{46}CaF_3^-$ | 102.949 | ref |
| $C_2H_4NO_2^-$ | 98.025 | 1470 | $^{103}Rh^-$ | 102.906 | 2370 |
| $^{98}Ru^-$ | 97.906 | 1876 | $AlF_4^-$ | 102.975 | 4030 |
| $^{98}Mo^-$ | 97.906 | 1880 | | | |

FIG. 9B

970

Table III. Masses of ions potentially interfering with $^{14}C^-$.

| Ion | mass (da) | RP Req'd | |
|---|---|---|---|
| $^{14}C^-$ | 14.00380 | ref | |
| $^{12}CH_2^-$ | 14.01620 | 1,130 | |
| $^{12}CD^-$ | 14.01455 | 1,303 | |
| $^{13}CH^-$ | 14.01173 | 1,766 | |
| $^{7}Li_2^-$ | 14.03256 | 487 | |
| $^{14}N^-$ | 14.00362 | 79,600 | not stable |

FIG. 9C

QUANTITATIVE MEASUREMENT OF ISOTOPE RATIOS BY TIME-OF-FLIGHT MASS SPECTROMETRY

FEDERAL RESEARCH STATEMENT

This invention was made with Government support under Grant Number GM079832 awarded by the National Institutes of Health. The Government has certain rights in this invention.

The section headings used herein are for organizational purposes only and should not to be construed as limiting the subject matter described in the present application in any way.

INTRODUCTION

Mass spectrometry has been used for more than seventy years to measure the isotope ratios of elements for many applications in numerous fields, such as geology, cosmology, and biology. Conventional mass spectrometry can be used to measure the mass of minor isotopes down to the part-per-million level. State-of-the-art accelerator mass spectrometers can perform measurements of minor isotopes down to the part-per-billion level. However, accelerating mass spectrometers are large and expensive.

BRIEF DESCRIPTION OF THE DRAWINGS

The present teachings, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the invention. The drawings are not intended to limit the scope of the Applicant's teachings in any way.

FIG. 5 presents a table that summarizes properties of one embodiment of the Bradbury-Nielsen timed ion selector that determine performance.

FIG. 9A illustrates a table of ion masses with the same nominal mass-to-charge ratio as $^{41}CaF^+$.

FIG. 9B illustrates a table of ion masses with the same nominal mass-to-charge ratio as $CaF_3^-$.

FIG. 9C illustrates a table of ion masses with the same nominal mass-to-charge ratio as $^{14}C^-$.

DESCRIPTION OF VARIOUS EMBODIMENTS

Figure 1:
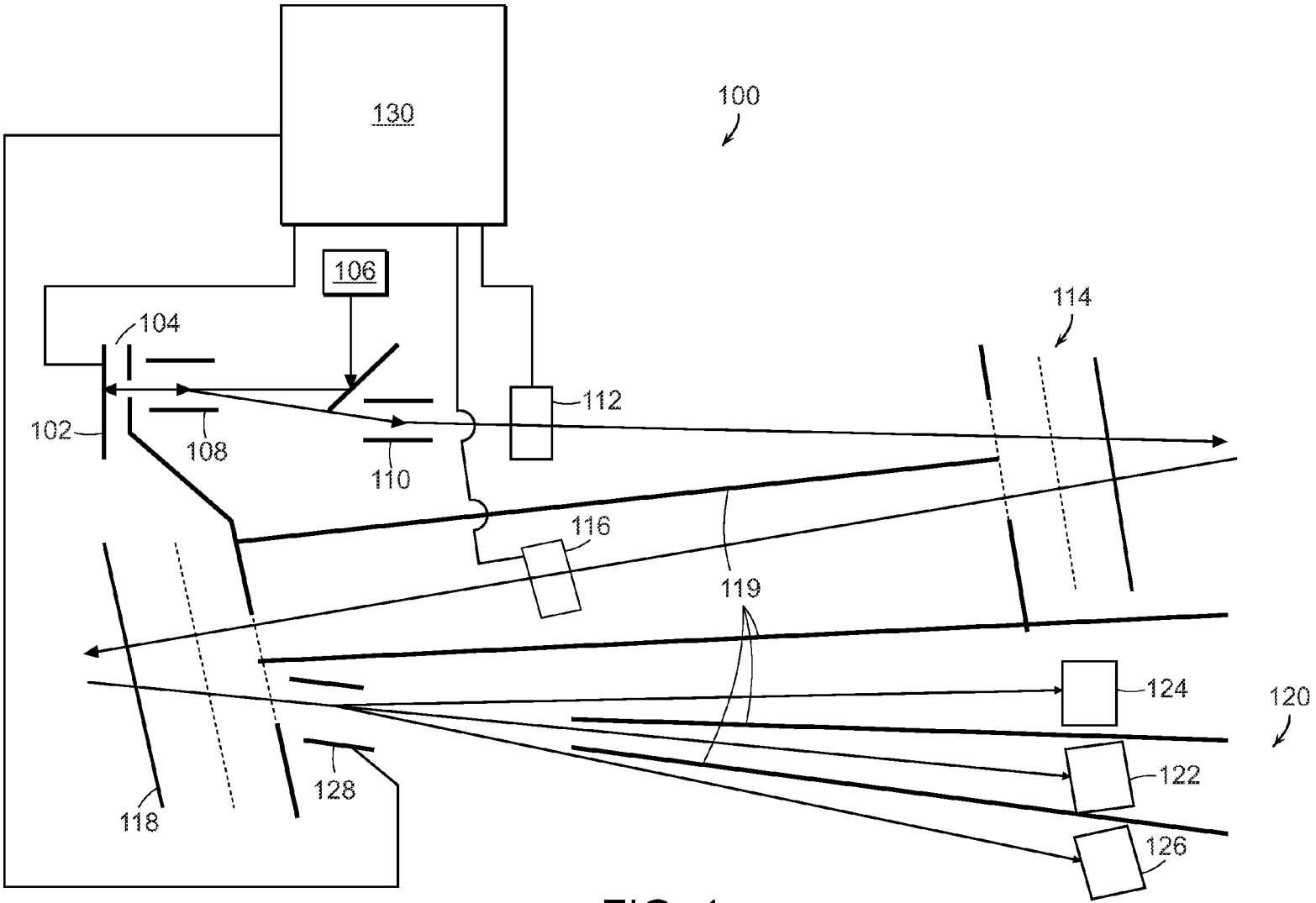
FIG. 1 illustrates a schematic diagram of a three-stage laser desorption time-of-flight mass spectrometer for determining isotope ratios according to the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

It should be understood that the individual steps of the methods of the present teachings may be performed in any order and/or simultaneously as long as the invention remains operable. Furthermore, it should be understood that the apparatus and methods of the present teachings can include any number or all of the described embodiments as long as the invention remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

Some mass spectrometry applications require the measurement of tracer isotopes down to the part-per-trillion level. The best tracers for quantitative work are those with the lowest natural abundance provided they can be measured with sufficient precision at low levels. The stable isotope with the least natural abundance is $^3He$, but it cannot be easily used in labeling studies because it is chemically inert. Most radioactive isotopes are very rare in nature except for some, such as $^{14}C$, which are created by cosmic rays in the upper atmosphere. Long-lived isotopes are preferred for tracer studies in humans because they can be administered at reasonable doses with minimal biological risk. However, these long-lived isotopes generally cannot be detected with sufficient sensitivity by classical radioactive counting techniques.

Many of these tracers can be prepared in nuclear reactors or accelerators. For example, $^{41}Ca$ is typically produced by irradiating calcium samples with neutrons in a nuclear reactor. Other radioisotopes, such as $^{45}Ca$ and $^{47}Ca$ are also formed by irradiating calcium samples but these have relatively short half-lives of 163 and 4.5 days, respectively. After a sufficient time, the $^{45}Ca$ decays leaving only $^{41}Ca$ with a half-life of 104,000 years. In addition to $^{14}C$ and $^{41}Ca$ other long-lived radioactive isotopes suitable for tracer studies include $^{3}H$ (tritium), $^{7}Be$, $^{10}Be$, $^{26}Al$, $^{36}Cl$, $^{59}Ni$, $^{63}Ni$, $^{99}Tc$, and $^{129}I$.

Applications measuring these tracer isotopes require a precise determination of the relative abundance of isotopes at levels less than $10^{-10}$ down to $10^{-15}$. These applications may involve radioactive isotopes with very long half-lives (greater than 1,000 years). Specific examples include $^{14}C$, which is used for radiocarbon dating, and $^{41}Ca$, which is used as a tracer for monitoring bone loss in human patients. Currently, such precise measurements of relative abundance of isotopes at levels less than $10^{-10}$ down to $10^{-15}$ require the use of large and expensive accelerator mass spectrometers (AMS). Such instruments are currently located in only a few facilities in the world. Accelerator mass spectrometers use multiple stages of separation to achieve the high abundance sensitivity required for precise measurements of these isotopes at very low levels.

Accelerator mass spectrometry was developed in the late 1970s to extend the range of radiocarbon dating techniques to older samples. Accelerator mass spectrometry can also measure very small quantities of sample material and can provide results much faster than conventional mass spectrometry and radioactive decay counting methods. Accelerator mass spectrometers have been used for geochronology and archaeology. More recently, accelerator mass spectrometers have been used for biological applications. Accelerator mass spectrometers have been successfully used to measure long-lived radioisotopes as biological tracers, but applications have been very limited by the relatively high cost and limited access to these instruments. In addition, a few highly specialized systems for measuring tritium, $^{14}C$, and plutonium have recently been developed, but such systems are not widely available.

There are known methods of using laser desorption time-of-flight mass spectrometry to measure isotope ratios of calcium and other metals. However, the abundance sensitivity demonstrated with these methods was less than $10^{-5}$, which is insufficient for accurate measurement of $^{46}Ca$, due to it $4\times10^{-5}$ relative abundance. The abundance sensitivity of known laser desorption time-of-flight mass spectrometry is many orders of magnitude less than the sensitivity required for accurate measurements of $^{41}Ca$. In general, time-of-flight mass spectrometry is thought to have limited dynamic range. Consequently, time-of-flight mass spectrometry has not been used extensively for measurements of isotope ratios.

The present invention relates to methods and apparatus for multi-stage laser desorption time-of-flight mass spectrometry that provide accurate measurements of very high abundance sensitivity of isotopes at very low levels. The methods and apparatus for laser desorption time-of-flight mass spectrometry is suitable for operation in any clinical or research laboratory. The methods and apparatus for laser desorption time-of-flight mass spectrometry according to the present invention can also be applied to applications requiring relatively small dynamic range, but where high precision, small sample size, and high throughput are required. More specifically, the time-of-flight mass spectrometer of the present invention uses multiple stages of high-resolution time-of-flight analyzers that allow separation of selected ions in both time and space to achieve the very high abundance sensitivity that is required for modern trace analysis.

FIG. 1 illustrates a schematic diagram of a three-stage laser desorption time-of-flight mass spectrometer 100 for determining isotope ratios according to the present invention. The mass spectrometer 100 includes a sample plate 102. For example, in one specific embodiment, the sample plate 102 comprises type 400 magnetic stainless steel, and provides a sample surface that is about 102×108 mm. In some embodiments, the sample plate 102 is coated or plated with a high purity material. Alternatively, a high purity metal foil can be attached to the sample plate 102. The sample plate 102 is installed on a precision x-y table that allows the laser beam to raster over the plate at any speed up to 20 mm/sec. The source vacuum housing containing the mass spectrometer 100 (not shown) includes a means for quickly changing the sample plate 102 without venting the system.

The mass spectrometer 100 includes a laser desorption pulsed ion source 104. In one embodiment, the pulsed ion source 104 comprises a two-field pulsed ion source. The pulsed ion source 104 includes a laser 106 that irradiates the sample to generate ions. For example one suitable laser 106 is a frequency tripled Nd: YLF laser operating at 5 kHz that produces about 120 μJ/pulse with a pulse width of 5 nsec in an ion beam that can be readily focused to a diameter of about 30 μm. In some embodiments, the pulsed ion source 104 comprises a matrix-assisted laser desorption/ionization (MALDI) pulsed ion source. However, is should be understood that non-MALDI pulsed ion sources can be used with the mass spectrometer of the present invention.

A first 108 and second ion deflector 110 are positioned after the pulsed ion source 104 in the path of the ion beam. The first and second ion deflectors 108, 110 deflect the ion beam to the first timed-ion-selector 112 in the mass analyzing section of the mass spectrometer 100. In some embodiments, the second ion deflector 110 deflects the ions at a relatively wide angle compared with known time-of-flight mass spectrometers. The first timed ion selector 112 is positioned in the path of the deflected ion beam and passes a portion of the ions and rejects other ions in the ion beam.

A first two-stage mirror 114 is positioned in the path of the ion beam exiting the first timed ion selector 112. The first mirror 114 focuses the ion beam at a second timed ion selector 116 that is located in the field-free space between the exit from the first ion mirror 114 and the entrance to a second ion mirror 118. In some embodiments, X-Y ion beam steering electrodes are located near the exit of the first ion mirror 114. The X-Y ion beam steering electrodes can be used to correct for minor misalignments of the components in the mass analyzer section of the mass spectrometer 100.

In some embodiments, the first and second timed ion selectors 112, 116 are Bradbury-Nielsen shutter or gate type ion selectors, which are optimized for the geometry and requirements of the mass spectrometer 100. Bradbury-Nielsen timed ion selectors are described in detail in connection with FIG. 4. The second ion mirror 118 reflects and focuses the ions to one or a plurality of ion detectors 120. Baffles 119 can be positioned between the second ion mirror 118 and the ion detectors 120. In various embodiments, a single ion detector or an ion detector assembly comprising an array of ion detectors can be used.

In the embodiment shown in FIG. 1, the mass spectrometer 100 includes three ion detectors that can have various configurations depending upon the requirements of the desired measurements. For example, in one embodiment, the center detector 122 is a Faraday cup with a 50 ohm output resistor, and the two side detectors 124, 126 are discrete dynode electron multipliers, such as the MagneTOF detector, which is a sub-nanosecond ion detector with high dynamic range. The MagneTOF detector is commercially available from ETP Electron Multipliers. The detectors 120 and one or both of the two discrete dynode electron multiplier side detectors 124, 126 can be coupled to a transient digitizer, which can perform signal averaging.

The mass spectrometer 100 can be configured for bipolar operation. In some embodiments, a timed ion deflector 128 is positioned proximate to the exit aperture of the second ion mirror 118. Applying a pulsed voltage to the timed ion deflector 128 will direct selected ions to any one of the detectors 122, 124, and 126. Entrance plates or entrance apertures on the detectors 122, 124, and 126 can be rotated through whatever angle is necessary to correct for the effect of ion deflection on resolving power. A computer controlled multi-channel delay generator 130 can be used to control the timing of the timed ion deflector 128, and the first and second timed ion selector 112, 116 relative to the initiation of the laser pulse in the pulsed ion source 104. For example, a computer controlled multi-channel delay generator with 1 nsec precision and accuracy can meet the requirements of many applications of the mass spectrometer.

It should be understood by those skilled in the art that the schematic diagram shown in FIG. 1 is only a schematic representation and that various additional elements would be necessary to complete a functional apparatus. For example, power supplies are required to power the pulsed ion source 104, the deflectors 108, 110, the first and second timed ion selectors 112, 116, the first and second ion mirrors 114, 118, and the detectors 120. In addition, a vacuum pumping arrangement is required to maintain the operating pressures in the vacuum chamber housing mass spectrometer 100 at the desired operating levels.

The mass spectrometer 100 can be a highly automated, relatively compact and inexpensive instrument that is suitable for routine, unattended use in a hospital or clinical research laboratory. The performance of the mass spectrometer 100 can be competitive with accelerator mass spectrometer instruments. However, the manufacturing cost for this instrument can be less than 10% of the cost of an accelerator mass spectrometer. Sample preparation procedures that have been developed for accelerator mass spectrometry can be employed with little or no modification.

In various modes of operation of the spectrometer of the present invention, samples are typically deposited on a metal sample plate as a slurry of fine particles suspended in a suitable liquid carrier (e.g. acetone) and allowed to dry. In some embodiments, silver powder or other substances are added to the sample to improve laser desorption. The laser 106 in the pulsed ion source 104 generates a pulsed laser beam that is directed onto the sample plate 102 in an approximately normal direction. The laser desorption rate is the rate that molecules are desorbed per laser pulse and is dependent on the laser pulse parameters. For example, the desorption rate of calcium is about $3\times10^{14}$ molecules per laser pulse at a laser energy of 120 microJoules/pulse and a pulse repetition rate of about 5 kHz. In many embodiments, the overall efficiency of the system is primarily determined by the degree of ionization of desorbed sample.

The characteristics of the pulsed laser beam are important because they determine the required geometry of the mass spectrometer for the desired performance. Higher resolving power in the mass spectrometer 100 can be achieved by keeping the pulsed ion source 104 and the focal lengths of the ion optics as short as practically possible. However, minimizing the focal lengths can increase the relative velocity spread after the first-order focus and seriously degrade the performance of subsequent mass spectrometer stages.

The ions generated by the pulsed ion source 104 exit along the axis of the laser beam. An accelerating voltage is applied to the sample plate 102 that accelerates the ions through an aperture in the extraction electrode so that the ions enter the first stage of the mass spectrometer 100. The first timed ion selector 112 passes a portion of the ions in the ion beam and rejects other ions in the ion beam. The first selected ions are directed to the first ion mirror 114.

The first ion mirror 114 generates one or more homogeneous, retarding, electrostatic fields that compensates for the effects of the initial kinetic energy distribution of the ions. As the ions penetrate the first ion mirror, with respect to the electrostatic fields, they are decelerated until the velocity component in the direction of the field becomes zero. Then, the ions reverse direction and are accelerated back through the reflector. The ions exit the first ion mirror with energies that are identical to their incoming energy, but with velocities that are in the opposite direction. Ions with larger energies penetrate the reflector more deeply and consequently will remain in the ion mirror for a longer time. In a properly designed ion mirror, the potentials are selected to modify the flight paths of the ions such that the travel time between the focal points for the ion mirror for ions of like mass and charge is independent of their initial energy.

The first ion mirror 114 directs the ion beam to the second timed ion selector 116 that is located in the field-free space between the exit of the first ion mirror 114 and the entrance to a second ion mirror 118. The second timed ion selector 116 passes a portion of the ions in the ion beam and rejects other ions in the ion beam. The second selected ions are directed to the second ion mirror 118. The second ion mirror 118 generates one or more homogeneous, retarding, electrostatic fields that further compensates for the effects of the initial kinetic energy distribution of the ions. The second ion mirror 118 directs the selected ions to a timed ion deflector 128 that deflects the selected ions to the detectors 120.

In embodiments including the baffles 119 only ions transmitted through small apertures in the baffles traverse to the ion detectors 120. The rejection efficiency is estimated to be at least 106. Thus, the probability that a rejected ion passes through the system and registers a signal that is indistinguishable from that due to any other ion differing by one mass unit or more is less than $10^{-24}$.

In various embodiments, the detectors 120 can be configured with the input at ground potential and the detector anodes can be biased at a voltage up to about 4 kV. The output signal on the 50 ohm load resistor is AC coupled to ground. Signal averaging can be performed by a transient digitizer electrically connected to the center detector 122 and one of the two side detectors 124, 126, which can be discrete dynode electron multipliers. For example, one of the two discrete dynode electron multiplier side detectors 124, 126 can be operated at high gain to yield an average signal of about 80 mV for a single ion. This signal is very large compared to electronic noise normally present in the system. The arrival time is generally limited to approximately a 1 ns window. Thus, in ion counting mode, the minimum detectable signal is limited only by the total analysis time.

Experimental measurements have determined that approximately half of the ions generated in the pulsed ion source 104 can be transmitted through the ion optics and detected by the detectors 120 with the configuration described in connection with FIG. 1. In many embodiments, the overall efficiency of the mass spectrometer 100, which includes the ionization efficiency, the transmission efficiency, and the detection efficiency, is greater than 0.001%. The ionization efficiency is the relative number of ions/molecule desorbed. The transmission efficiency is the ratio of the number of desired ions transmitted through the ion optics to the number of ions produced in the ion source. The detection efficiency is the ratio of the number of ions that contributes to the detection signal to the number of ions transmitted. However, the ratio of the number of desired ions detected to the total signal generated by the detector for the mass spectrometer 100 can be degraded by scattering abundant components and contaminants that are approximately isobaric with the low-level components.

The methods and apparatus for time-of-flight mass spectrometers of the present invention provide very high abundance sensitivity of isotopes at very low levels that can be below the part-per-billion level. These applications generally involve radioactive isotopes with very long half-lives (>1000 years). Specific examples include $^{14}C$ for radiocarbon dating and biological tracer studies and $^{41}Ca$ for biological tracer studies.

Successful measurements of $^{41}Ca$ assay in patients could have wide benefits including improved risk assessment for disease progression, monitoring treatment response, evaluation of treatment-related bone loss, and early detection of treatment failure. For example, measurements the $^{41}Ca/Ca$ ratio in urine and in serum that is used to evaluate the calcium metabolic status of patients may enable early detection of numerous diseases, such as osteoporosis, multiple myeloma, and cancer metastatic to the bone as well as a measurement of the extent of bone disease, such as osteoporosis, bone cancers, kidney disease, and other bone related disease. It has been estimated that as much as 30% of the population could benefit from a simple and inexpensive diagnostic test that monitors bone loss rate and that such diagnostic tests could lead to better quality of life for the general population and lower medical care costs.

More specifically, the bone remodeling sequence includes (a) increased bone turnover, (b) imbalance at remodeling sites, and (c) uncoupling of bone formation and resorption. Accelerated bone turnover alone will result in inadequate or impaired mineralization and even a dynamic bone disease. Multiple studies have shown that the extent of established skeletal disease is highly correlated with bone turnover. Accurate measurements of $^{41}Ca$ ratios will facilitate more accurate individual patient assessment because serial urinary $^{41}Ca/Ca$ measurements in biological fluids using mass spectrometry are less variable for an individual than present clinical bone turnover markers (5% versus 20-30% or greater).

The $^{41}Ca$ isotope is relatively easy to administer to patients. A dose of the $^{41}Ca$ isotope can be given orally or with further preparation it can be given intravenously. Serum or urine can be collected at any time during the day. A single dose of $^{41}Ca$ represents a lifetime dose for an individual. Changes in the rate of bone loss can be monitored with a relatively simple and inexpensive measurement of the $^{41}Ca$ ratio at any subsequent time. Such a test could be incorporated into an annual physical exam for nominally healthy individuals, or more frequently as required for evaluation of osteoporosis, bone cancers, kidney disease and other bone related diseases.

Diagnostic testing with the $^{41}Ca$ assay is relatively safe. The radiological safety of $^{41}Ca$ is a key benefit of utilizing this "mildly radioactive" isotope as a long-term bone tracer. The $^{41}Ca$ isotope has a long half-life (104,000 years) and low energy decay mode resulting from electron capture. The lifetime exposure from an ingested 120 mg $^{41}Ca$ dose is equivalent to $^{10}nCi$ or $^{370}Bq$, which is similar to 40 minutes of background radiation, and is only one fiftieth of the dose of a single x-ray bone density test.

The $^{41}Ca$ isotope is relatively easy to produce. The $^{41}Ca$ isotope is a neutron capture product of the most abundant calcium isotope $^{40}Ca$. All nuclear research facilities have neutron irradiation capabilities facilities and there are many worldwide. The $^{41}Ca$ isotope stock would be available for use after the simultaneously production of $^{45}Ca$ from neutron capture of trace $^{44}Ca$ as the target material decays to safe levels (i.e., several months after reactor unload).

The $^{41}Ca$ isotope is relatively inexpensive to produce. It is estimated that the cost of measuring the $^{41}Ca$ isotope with a mass spectrometer according to the present invention can be less than $1 per sample with a single instrument analyzing 30,000 samples per year. The commercial price of a $^{41}Ca$ dose and the charge for the test will be significantly higher than the measurement costs. It is estimated that the production of 4,000 new $^{41}Ca$ doses could be accomplished for a total cost of less than $2/dose, which is much less than an approximate $1,000 cost for enriched $^{46}Ca$ doses and $10,000 for enriched $^{44}Ca$.

Bone loss measurements cannot be done practically using more abundant calcium isotopes because very large doses would be required to allow measurements beyond a few weeks after administration. Data and kinetic model predicts that a 10% change in bone turnover due to disease progression or therapeutic response, which is completely invisible by any other known means, would be quantifiable in a matter of weeks by measuring the $^{41}Ca$ isotope. However, measurements of the $^{41}Ca$ isotope usually require precise determination of the relative abundance of isotopes at levels below $10^{-10}$ and extending down to $10^{-15}$.

Figure 2:
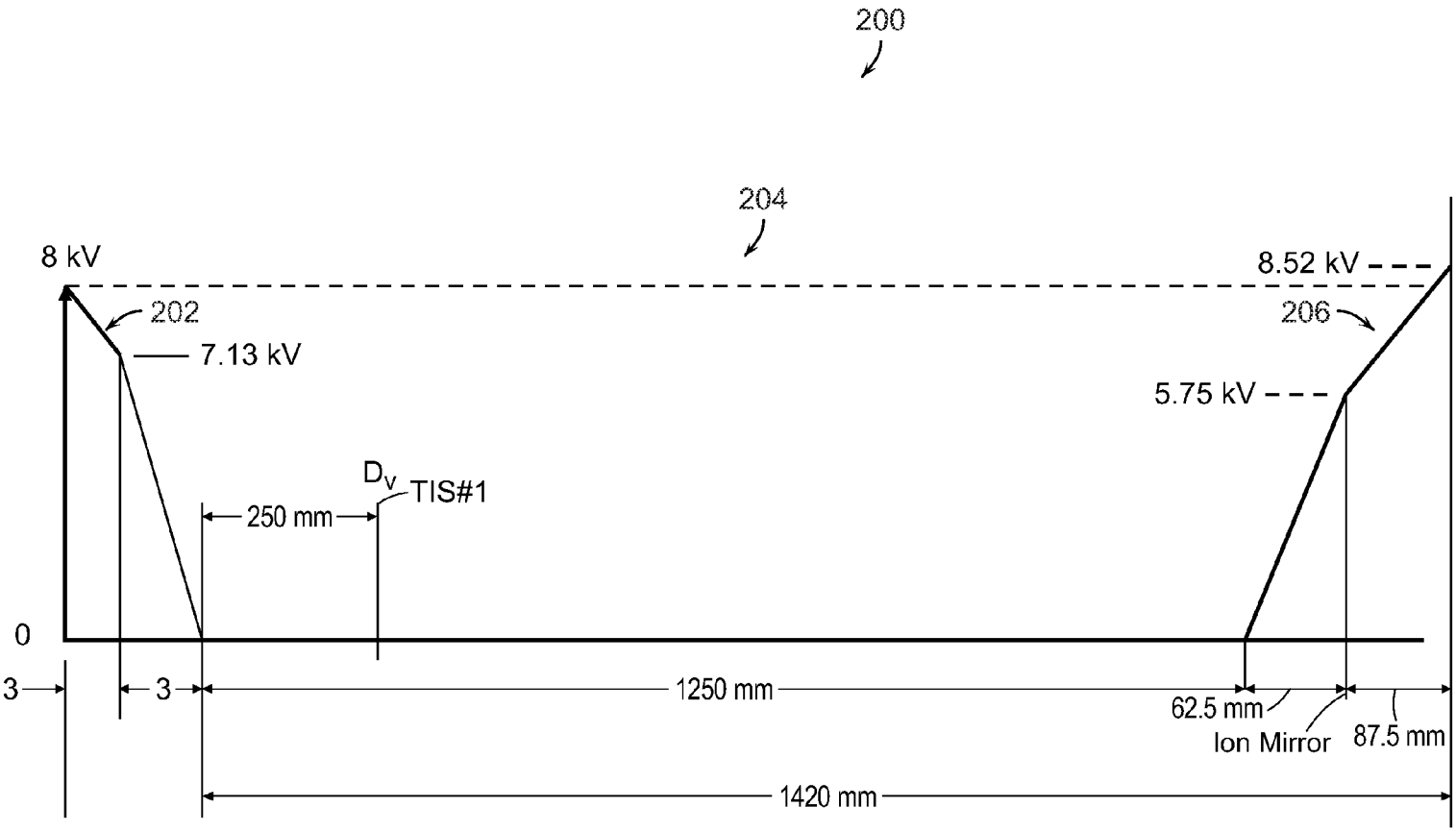
FIG. 2 illustrates a potential diagram of the first stage of the mass spectrometer described in connection with FIG. 1 in the region from the pulsed ion source to the first ion mirror.

FIG. 2 illustrates a potential diagram 200 of the first stage of the mass spectrometer 100 described in connection with FIG. 1 in the region from the pulsed ion source 104 to the first ion mirror 114. The potential diagram 200 illustrates the application of an accelerating potential to the sample plate 102 that accelerates the ions generated by the pulsed ion source 104 towards the ion deflectors 108, 110. The potential diagram 200 also illustrates an acceleration region 202 where the ions are accelerated into the mass analyzer section of the mass spectrometer 100. The accelerating region 202 is followed by a field free region 204. The potentials and the time delay between the laser pulse and the acceleration pulse are chosen so that ions of a predetermined mass and charge reach the first timed ion selector 112 at a time that is nearly independent of the initial position and velocity of the ions prior to acceleration.

The potential diagram 200 illustrates a decelerating field region 206 that is associated with the first ion mirror 114. The potentials applied to the first ion mirror 114 are chosen so that ions of a predetermined mass and charge reach the second timed ion selector 116 at a time that is nearly independent of the initial position and velocity of the ions prior to acceleration. Also, the potentials applied to the second ion mirror 118 are chosen so that ions of a predetermined mass and charge reach the detector 120 at a time that is nearly independent of the initial position and velocity of the ions prior to acceleration. In addition, the potentials applied to the timed ion deflector 128 are chosen so that ions of a predetermined mass and charge reach a predetermined one of the detectors 122, 124, or 126 at a time that is nearly independent of the initial position and velocity of the ions prior to acceleration.

Figure 3A:
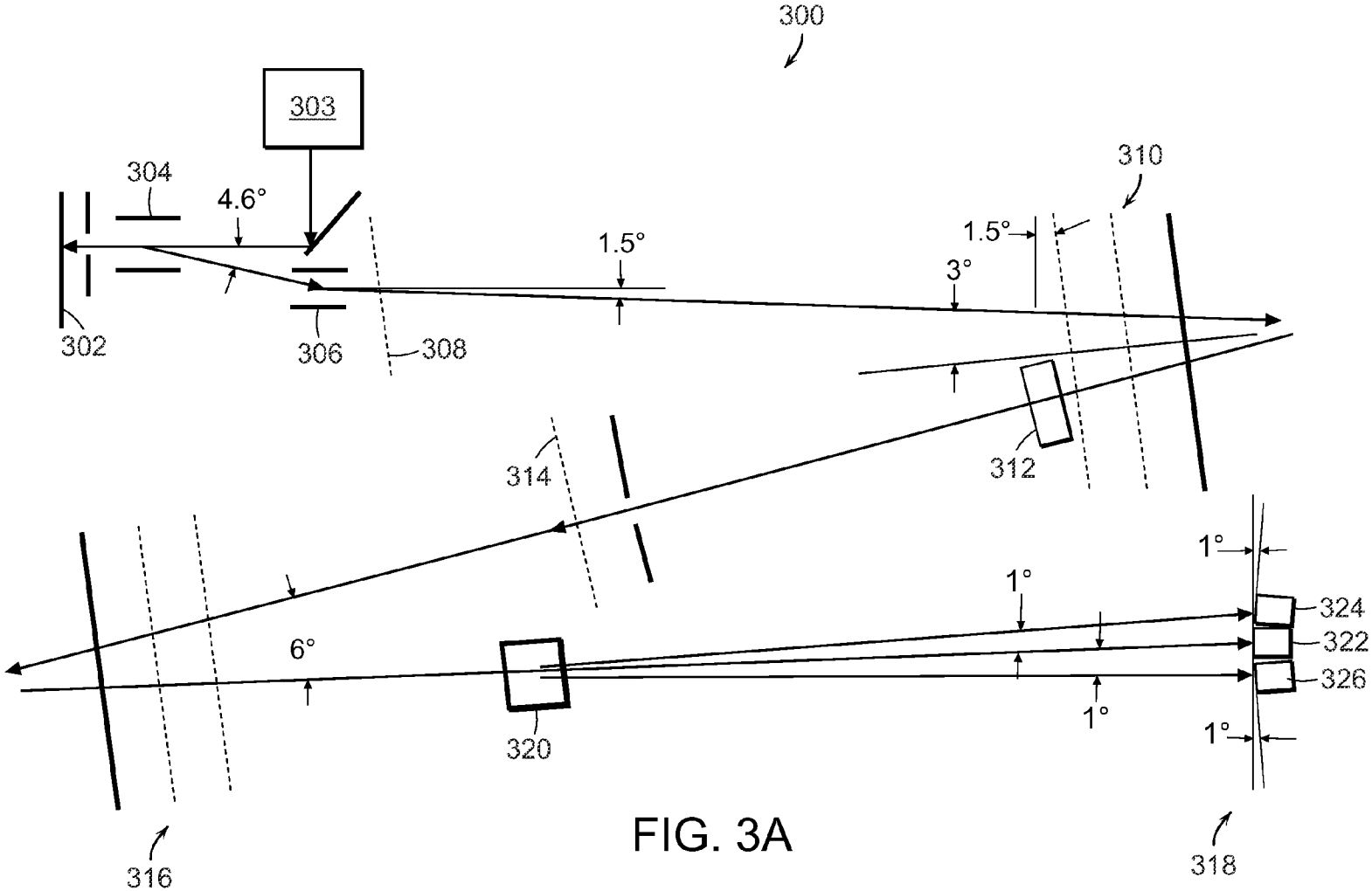
FIG. 3A illustrates a schematic diagram of a specific embodiment of a MALDI time-of-flight mass spectrometer according to the present invention that has the high abundance sensitivity necessary for precise measurements of isotopes at very low levels.

FIG. 3A illustrates a schematic diagram of a specific embodiment of a MALDI time-of-flight mass spectrometer 300 according to the present invention that has the high abundance sensitivity necessary for precise measurements of isotopes at very low levels. The mass spectrometer 100 includes a pulsed ion source 302 including a laser 303, such as the pulsed ion source 104 described in connection with FIG. 1. A first ion deflector 304 is positioned in the ion beam to deflect the ions generated by the pulsed ion source 302. In one specific embodiment, the first ion deflector 304 deflects the ion beam at an angle that is approximately 4.6 degrees.

A second ion deflector 306 is positioned in the path of the ion beam deflected by the first ion deflector 304. The second ion deflector 306 deflects the ion beam at a predetermined angle. In some embodiments, the second ion deflector 306 deflects the ion beam at a predetermined angle that reduces or minimizes the ion trajectory error that limits the resolving power of the mass spectrometer.

The mass spectrometer 300 also includes a first timed ion selector 308 positioned in the path of the ion beam. In one embodiment, the first timed ion selector 308 comprises a Bradbury- Nielsen timed ion selector with alternating wire ion gates that is described in connection with FIG. 4. In addition, the mass spectrometer 300 includes the first ion mirror 310. In some embodiments of the present invention, the entrance of the first ion mirror 310 is tilted at substantially the same predetermined angle relative to the direction of the ion beam propagation as the predetermined angle that the ion beam is deflected by the second ion deflector 306, but in the opposite direction as shown in FIG. 3. It has been determined that the deflection of the ion beam with the second ion deflector 306 through the predetermined angle and tilting the entrance of the first ion mirror 310 at substantially the same predetermined angle, but in the opposite direction, greatly minimizes the ion trajectory error that limits the resolving power of the time-of-flight mass spectrometer. In one specific embodiment, the predetermined angle is about 1.5 degrees.

In addition, the mass spectrometer 300 includes a beam steering device 312 that is positioned in the path of the ion beam reflected by the first ion mirror 310. The beam steering device 312 directs the ion beam to the second timed ion selector 314. The second timed ion selector 314 comprises a Bradbury-Nielsen timed ion selector with alternating wire ion gates that is described in connection with FIG. 4. A second ion mirror 316 is positioned in the path of the ion beam. The second ion mirror 316 is positioned at the same predetermined angle as the first ion mirror 310 relative to the direction of the ion beam propagation. In one embodiment, the first and second ion mirrors 310, 316 are two-stage gridded ion mirrors comprising grids that are nominally about 96% transparent. The transmission efficiency of the ion mirrors 310, 316 is expected to be about 85% assuming the ions interact with the four grids. Thus, the total transmission efficiency due to grid losses is estimated at 65% for the complete mass spectrometer. In normal operation, no significant ion beam broadening will occurs in the ion mirrors 310, 316 because the fields are uniform and the velocity spread is relatively small.

The second ion mirror 316 directs the ions to a detector assembly 318. A timed ion deflector 320 can be positioned between the second ion mirror 316 and the detector assembly 318 to deflect ions to various detectors in the detector assembly 318. Applying a pulsed voltage to the timed ion deflector 320 will direct selected ions to any one of the detectors 322, 324, and 326. Entrance plates or entrance apertures on the detectors 322, 324, and 326 can be rotated through whatever angle is necessary to correct for the effect of ion deflection on resolving power. In one embodiment, ions are directed to detector 322 with no deflection voltage applied to deflector 320 and the entrance plane of detector 322 is parallel to the exit plane of ion mirror 316. In one embodiment, a deflection voltage is applied to deflector 320 to deflect ions by one degree to direct ions toward detector 324 and the entrance plane of detector 324 is rotated by one degree in the opposite direction relative to the exit plane of the mirror. At least one of the detectors 322, 324, and 326 in the detector assembly 318 can comprise a MagneTOF ion detector, which is a sub-nanosecond ion detector with high dynamic range. The detection efficiency for the MagneTOF detector is at least 80%. Therefore, the overall efficiency of the mass spectrometer 300 can be in the 50% range. There should not be any other significant losses when measuring isotopes at very low levels that have relatively low masses and relatively high energies.

A computer controlled multi-channel delay generator is typically used to control the timing of the timed ion deflector 320, and the first and second timed ion selector 308, 314 relative to the initiation of the laser pulse in the pulsed ion source 302. For example, a computer controlled multi-channel delay generator with 1 nsec precision and accuracy can meet the requirements of many applications of the mass spectrometer.

Figure 3B:
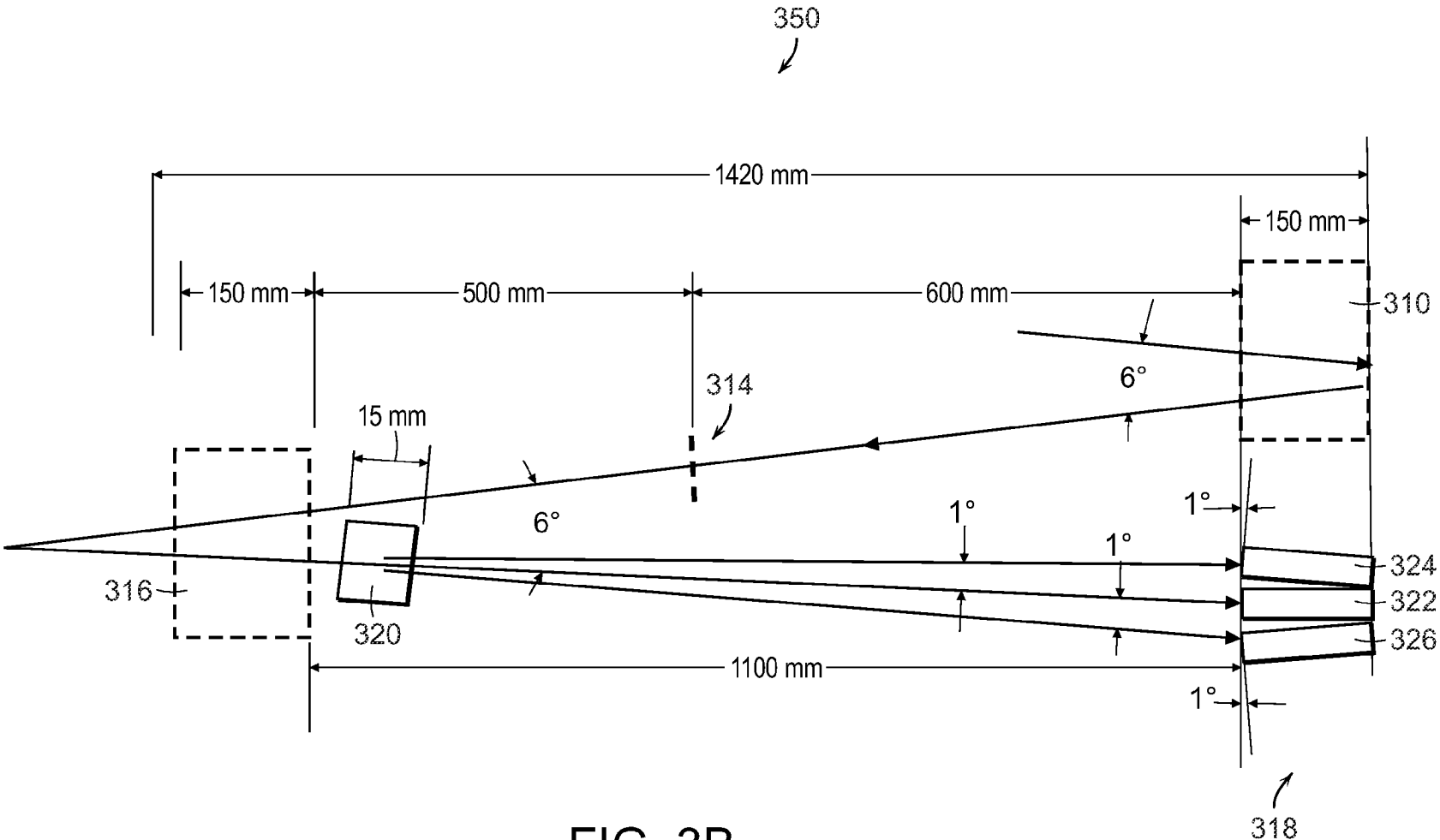
FIG. 3B illustrates a schematic diagram of a specific embodiment of the second stage of the MALDI time-of-flight mass spectrometer that was described in connection with FIG. 3A.

FIG. 3B illustrates a schematic diagram of one specific embodiment of the second stage 350 of the MALDI time-of-flight mass spectrometer 300 that was described in connection with FIG. 3A. The second stage 350 of the MALDI TOF mass spectrometer includes the elements from the first ion mirror 310 to the detector assembly 318. Dimension for a specific embodiment of the second stage of the MALDI time-of-flight mass spectrometer that has the high abundance sensitivity necessary for precise measurements of isotopes at very low levels are shown in FIG. 3B.

It should be understood by those skilled in the art that the schematic diagram shown in FIGS. 3A and 3B is only a schematic representation and that various additional elements would be necessary to complete a functional apparatus. For example, power supplies are required to power the ion source 302, the first and second deflectors 304, 306, the first and second timed ion selectors 308, 314, the first and second ion mirrors 310, 316, and the detector assembly 318. In addition, a vacuum pumping arrangement is required to maintain the operating pressures in the vacuum chamber housing the components at the desired operating levels.

One method according to the present invention measures the isotope ratios in carbon. In this method, the first timed ion selector 112 removes ions with mass 12 from the ion beam. The second timed ion selector 116 selects both ion masses 13 and 14. Ions with mass 13 are passed through to the center detector 122 and ions with mass 14 are deflected to one of the side detectors 124, 126. The signal generated by the center detector 122 is monitored by a digital electrometer. The monitored signals are averaged over the measurement time period. The time spectra for ions detected at detector 122, 124, and 126 are recorded in the vicinity of the expected peak using a time-to-digital converter, which produces an integrated histogram of all of the ions detected. By summing over the peaks corresponding to $^{13}C$ and $^{14}C$ and then subtracting the background (if any) in adjacent channels, a precise determination of the ions detected during the measurement time can be made.

In one exemplary measurement, the Faraday cup comprising the center detector 122 generates a full scale signal of about 200 mV, which corresponds to about $2.5\times10^7$ ions/pulse in a single digitizer channel. The minimum measurable signal on the channel is about 1,000 ions/pulse. The gain on the low-gain multiplier can be adjusted to cover the range from about 0.01 ions/pulse to 10,000 ions per pulse with a dynamic range of about 1,000 at any particular gain setting. For a two hour measurement at a 5 kHz rate ($3.6\times10^7$ pulses) 1 ion/million pulses yields 36 ions measurable with a nominal precision of better than 20%. The sensitivity of the Faraday cup detector can be reduced, if necessary, by reducing the load resistance. For example, with a 1 ohm load resistor, up to $10^9$ ions per laser pulse is within the linear dynamic range. Thus, the total range is about $10^{15}$, and the properties of the detectors can be adjusted to accommodate the relative abundances of the isotopes monitored. Commercially available transient digitizers with on-board averaging and time-digital-convertors (TDCs) can be used for recording the spectra.

One method according to the present invention measures the isotope ratios $^{41}Ca/^{46}Ca$ at very low levels. The first timed ion selector 112 removes $^{40}CaF_3^-$ at m/z 97 and transmits masses 98-105 corresponding to the other Ca isotopes. The high-resolution second timed ion selector 116 switches polarity each time an ion of interest reaches the selector and it can be programmed to transmit only m/z 97.958 and 102.949, which correspond to $^{41}Ca$ and $^{46}Ca$ or it can be programmed to transmit all or any selected set. The second timed ion selector 116 operates at high resolution to remove any contaminants differing in mass from the selected ions by more than ca. 200 ppm. The mass corresponding to $^{46}Ca$ is directed to the one of the side detectors 124, 126 set to an appropriate gain. The mass corresponding to $^{41}Ca$ is directed to the other side detector 124 or 126 set to an appropriate gain. The other isotopes can be determined by transmitting the ions to the Faraday cup comprising the center detector 122.

Figure 4:
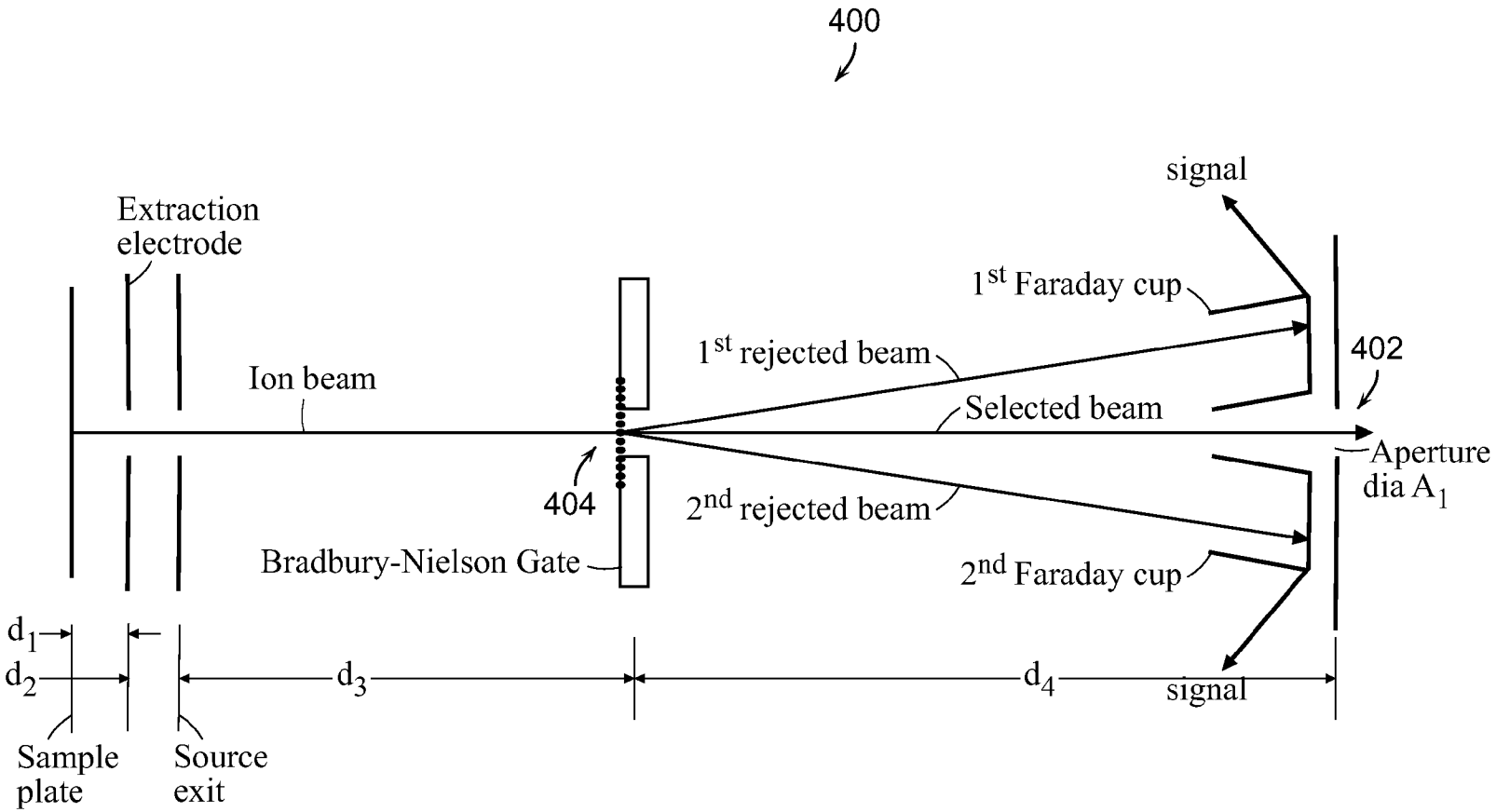
FIG. 4 illustrates one embodiment of a timed ion selector gate according to the present invention.

FIG. 4 illustrates one embodiment of a timed ion selector gate 400 according to the present invention. The timed ion selector gate 400 is a Bradbury-Nielsen type ion shutter or gate, which is an electrically activated ion gate. Bradbury-Nielsen timed ion selectors include parallel wires that are positioned orthogonal to the path of the ion beam. High-frequency voltage waveforms of opposite polarity are applied to alternate wires in the gate. The gates only pass charged particles at certain times in the waveform cycle when the voltage difference between wires is near zero. At other times, the ion beam is deflected to some angle by the potential difference established between the neighboring wires. The wires are oriented so that ions rejected by the timed ion selectors 314, 320 are deflected away from the exit aperture 402.

In one specific embodiment of the Bradbury-Nielsen timed ion selector used in mass spectrometers according to the present invention that are capable of precise measurements of the relative abundance of isotopes at low levels, the effective distance from the pulsed ion source 302 to the input of the Bradbury-Nielsen comprising the first timed ion selector 314 is about 275 mm. In addition, the distance from the entrance aperture 404 to the exit aperture 402 of the Bradbury-Nielsen timed ion selector (shown as d4 in FIG. 4) is about 1,000 mm. The exit aperture 402 in the Bradbury-Nielsen timed ion selector is about 3 mm in diameter. In one embodiment, the spacing between wires in the Bradbury-Nielsen timed ion selector is about 1.5 mm.

The Bradbury-Nielsen timed ion selectors can be operated in either a "low resolution" mode or a "high resolution" mode. In the "low resolution" mode, the voltage applied to the wires is reduced to zero before the ions of interest reach the electric field generated by the wires and established again after the ions pass the field. The low resolution operating mode is generally useful for selecting a mass range for transmission, but is not practical for selection of a single mass with high resolving power. The low resolution operating mode is strongly dependent on wire spacing. The best resolving power is obtained with smaller wire spacing since time uncertainty is much less important.

In the "high-resolution" operating mode of the Bradbury-Nielsen ion selector, a switching voltage is rapidly applied to adjacent wires to switch the polarity of the wires at the time that the center of the packet of selected ions reaches the plane of the entrance aperture 404. The deflection of ions is proportional to their distance from the plane of the entrance aperture 404 at the time the polarity switches. The resolving power can be adjusted by varying the amplitude of the voltage applied and is only weakly affected by the speed of the transition. In one embodiment where precise measurements of the relative abundance of isotopes at low levels can be obtained, a power supply provides the wires of the Bradbury-Nielsen ion selector with an amplitude of approximately +/−500 volts with 7 nsec switching time.

The variation in initial ion positions (designated by Δx) and the variation of ion velocities (designated by dv) at the time the accelerating pulse is applied to the sample plate 102 both limit the maximum resolving power of the mass spectrometer 100. The peak width of the mass spectrum 100 at the first and second order focal point for the focused mass is determined primarily by variation in initial position. The peak width of the mass spectrum at the first and second order focal point due to variation in initial position (designated by Δx) is given by the following equation:

$$\delta t_s=(t/2)R_{s1}=(D_e/2v_n)[(D_v-D_s)/D_e](\Delta x/d_1y)=[(D_v-D_s)/v_n](\Delta x/2d_1y)=0.14\text{ ns}$$

The peak width of the mass spectrum due to the initial velocity dispersion (designated by $\delta v_0$) is given by the following equation:

$$\delta t_{v1}=(t/2)R_{v1}=(D_e/2v_n)[4d_1y/D_e](\delta v_0/v_n)[1-(m/m^*)^{1/2}]=(2d_1y/v_n)(\delta v_0/v_n)=1.44)[1-(m/m^*)^{1/2}]\text{ ns}$$

$$\delta t_{v2}=(t/2)R_{v2}=2(D_e/2v_n)[2d_1y/(D_v-D_s)](\delta v_0/v_n)^2(\Delta D_{12}/D_e)=[\Delta D_{12}/(D_v-D_s)](2d_1y/v_n)(\delta v_0/v_n)^2=4.8\times10^{-5}\Delta D_{12}\text{ ns}$$

$$\delta t_{v3}=(t/2)R_{v3}=4(D_e/2v_n)[2d_1y/(D_v-D_s)]^3(\delta v_0/v_n)^3=10^{-7}D_e\text{ ns}$$

where $\Delta D_{12}$ is the difference between the first and second order velocity focal distances. In the worst case, $\Delta D_{12}$ is a small fraction of the total effective length $D_e$. Therefore, the second and third order velocity contributions to the peak width are negligible compared with contributions to the peak width corresponding to the initial ion position at both the first ion selector 308 and the second ion selector 314.

The width of peaks in the mass spectrum at the second timed ion selector 314 are calculated from the above equations for nominal parameter values of Δx=0.01 mm, $\delta v_0=4\times10^{-4}$ mm/ns, Δt=250 ns, $D_e$=2650 mm, $v_n$=0.124 mm/ns (V=8 kV, m=0.1 kD), $d_1$=3 mm and for y=9.2, $D_s$=154, $D_v$=251 mm, and dv/v=0.0018. These parameters also apply to timed ion selector 308 except that $D_e$=265 mm.

For isotope ratio measurements, the maximum mass ratio m*/m is equal to 14/13 for C measurements. For Ca measurements, the maximum ratio is 103/98. Thus, the contribution from the first order velocity contribution $\delta t_{v1}$ is less than or equal to 0.054 ns. Since the first order velocity contribution is uncorrelated with the contribution from the initial position, the maximum peak width is given by $\Delta t=[(0.142)^2+(0.0542)^2]^{1/2}=0.15$ ns.

FIG. 5 presents a table 500 that summarizes properties of one embodiment of the Bradbury-Nielsen timed ion selector that determine performance. FIG. 5 presents a table 500 that summarizes the performance of the Bradbury-Nielsen timed ion selectors as a function of important device parameters. The performance of the Bradbury-Nielsen timed ion selectors is primarily determined by the time and space dispersion of the ions at the gate aperture 404. The peak width of the ion mass spectrum typically needs to be less than 0.2 ns for precise measurements of isotopes at very low levels if the Bradbury-Nielsen timed ion selector is placed at the point where first and second order focusing occurs. For example, in one specific embodiment, the exit aperture 402 of the first Bradbury-Nielsen timed ion selector is positioned in front of the first ion mirror 310 (FIG. 3A) with the dimension $d_4$ equal to about 1,000 mm and the second Bradbury-Nielsen timed ion selector is positioned in front of the second ion mirror 316 with the dimension $d_4$ equal to about 2,400 mm. Performance of the timed ion selector may be limited by either the physical distance between peaks relative to the spacing of the wires in the Bradbury-Nielsen gate or by the time interval between peaks relative to the time width of the peaks. These parameters are given by $$\Delta D/D_e=\Delta t/t_0=\Delta m/2m$$

where $\Delta m$ is the mass difference (1 Da in this example), $t_0$ is the flight time, and $D_e$ is the effective flight distance. Examples of calculated values for $\Delta D$ and $\Delta t$ for timed ion selectors 308 ($D_e$=265 mm) and 314 ($D_e$=2650 mm) are shown in FIG. 5 for $CaF_3$ (nominal mass 100 Da) and for C (nominal mass 14 Da) with accelerating voltages of 8 and 0.9 kV, respectively.

Figure 6:
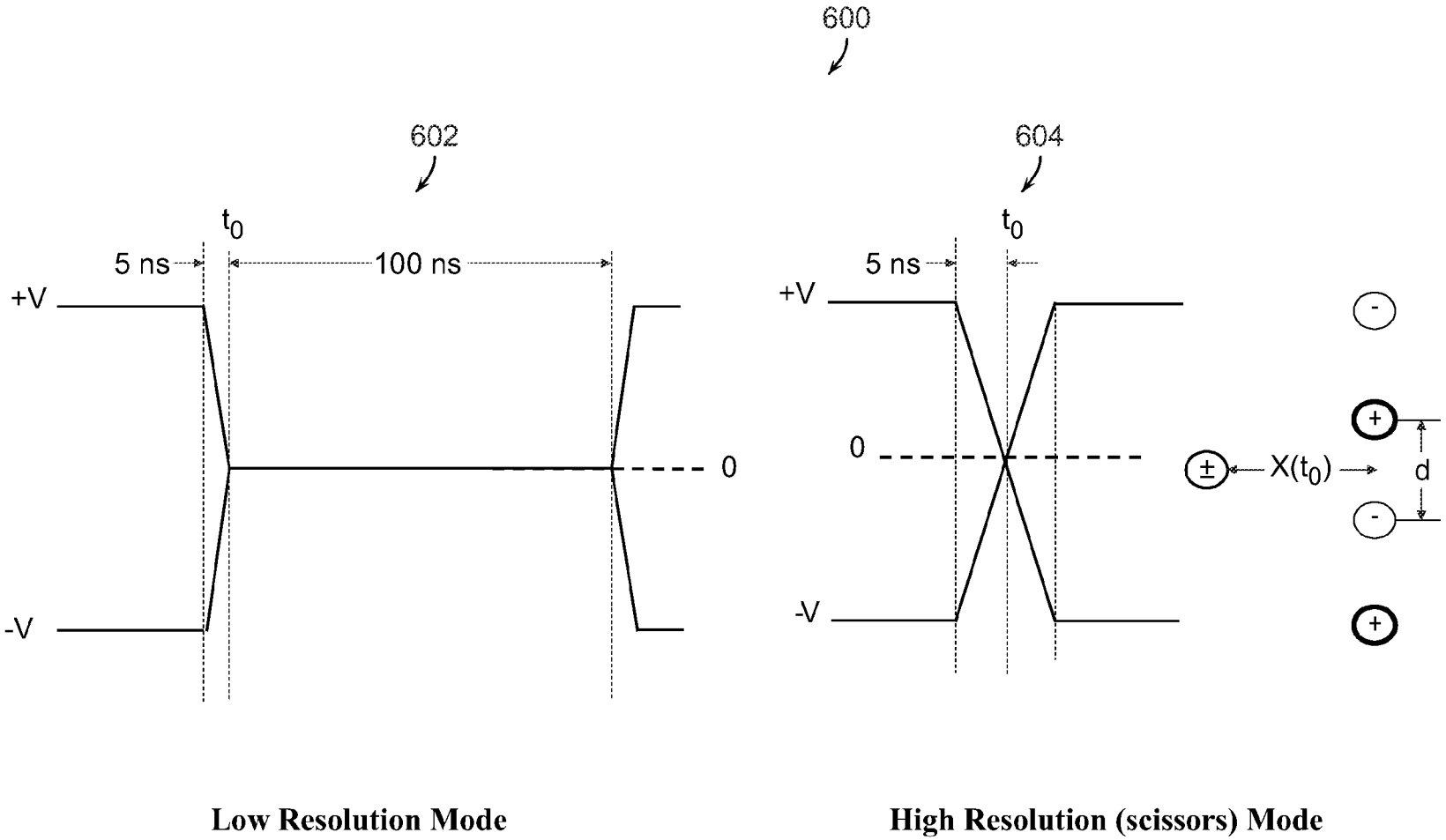
FIG. 6 illustrates typical voltage waveforms that are applied to the first and second Bradbury-Nielsen timed ion selector in a mass spectrometer according to the present invention that are capable of precise measurements of the relative abundance of isotopes at low levels.

FIG. 6 illustrates typical voltage waveforms 600 that are applied to the first and second Bradbury-Nielsen timed ion selector in a mass spectrometer according to the present invention that are capable of precise measurements of the relative abundance of isotopes at low levels. Low resolution mode waveforms 602 and high resolution mode waveforms 604 are presented. The low resolution mode is used for selecting a mass range with the first Bradbury-Nielsen timed ion selector and the high resolution mode is used for selecting specific peaks with the second Bradbury-Nielsen timed ion selector. Multiple mass spectrum peaks can be selected with second Bradbury-Nielsen timed ion selector provided that the arrival times differ by at least 100 ns.

The equations for calculating the performance of a Bradbury-Nielsen type timed ion selector are known. Deflection angle can be determined from the following equation assuming that the voltage is turned on when the ion is at position $x_0$ and then turned off when the ion is at position $x_1$ relative to the plane of the gate:

$$\tan\alpha(x_0, x_1)=k(V_p/V_0)[(2/\pi)\tan^{-1}(\{\exp((\pi x_1/d_e)\}-(2/\pi)\tan^{-1}\{\exp(\pi x_0/d_e)\}]$$

where k is a deflection constant given by $k=\pi 2\ \ln[\cot(\pi R/2d)]\}^{-1}$, $V_p$ is the deflection voltage ($+V_p$ on one wire set, $-V_p$ on the other), $V_0$ is the accelerating voltage of the ions, and $d_e$ is the effective wire spacing given by $d_e=d\cos[(\pi(d-2R)/4d]$, where d is the distance between wires and R is the radius of the wire. The angles are expressed in radians.

Ions approaching the Bradbury-Nielsen type timed ion selectors are traveling in the negative x direction and ions leaving the Bradbury-Nielsen type timed ion selectors are traveling in the positive x direction. For continuous application of the deflection voltage, $x_0$ goes to negative infinity, and $x_1$ goes to positive infinity. Thus, for a continuous deflection voltage, the deflection angle can be expressed by the following equation:

$$\tan\alpha_{max}=k(V_p/V_0).$$

When the high resolution switching voltage is applied, the deflection voltage applied to the wires in the Bradbury-Nielsen type timed ion selectors is reversed when the ions are at a distance x from the plane of the entrance aperture. The deflection angle in the high resolution mode is given by the following equation:

$$\tan\alpha=k(V_p/V_0))[(2/\pi)\tan^{-1}(\{\exp((\pi x/d_e)\}-1]$$

In the low resolution mode, the deflection voltage is initially on and is turned off when an ion of interest is at distance $x_1$ from the plane of entrance aperture 404. The deflection angle in the low resolution mode is given by the following equation:

$$\tan\alpha=k(V_p/V_0))[(4/\pi)\tan^{-1}(\{\exp((\pi x_1/d_e)\}].$$

When the deflection voltage is turned on with the ion at position $x_2$, the deflection angle is given by the following equation:

$$\tan\alpha=k(V_p/V_0))[1-(2/\pi)\tan^{-1}(\{\exp((\pi x_2/d_e\}].$$

The width of ion packets corresponding to a particular mass-to-charge ratio when measuring the relative abundance of isotopes at low levels is small, for example, less than 0.2 ns for some isotopes. Deflection of the selected ions corresponding to x=0 is primarily determined by the uncertainty in the time that the voltage waveform switches.

Figure 7:
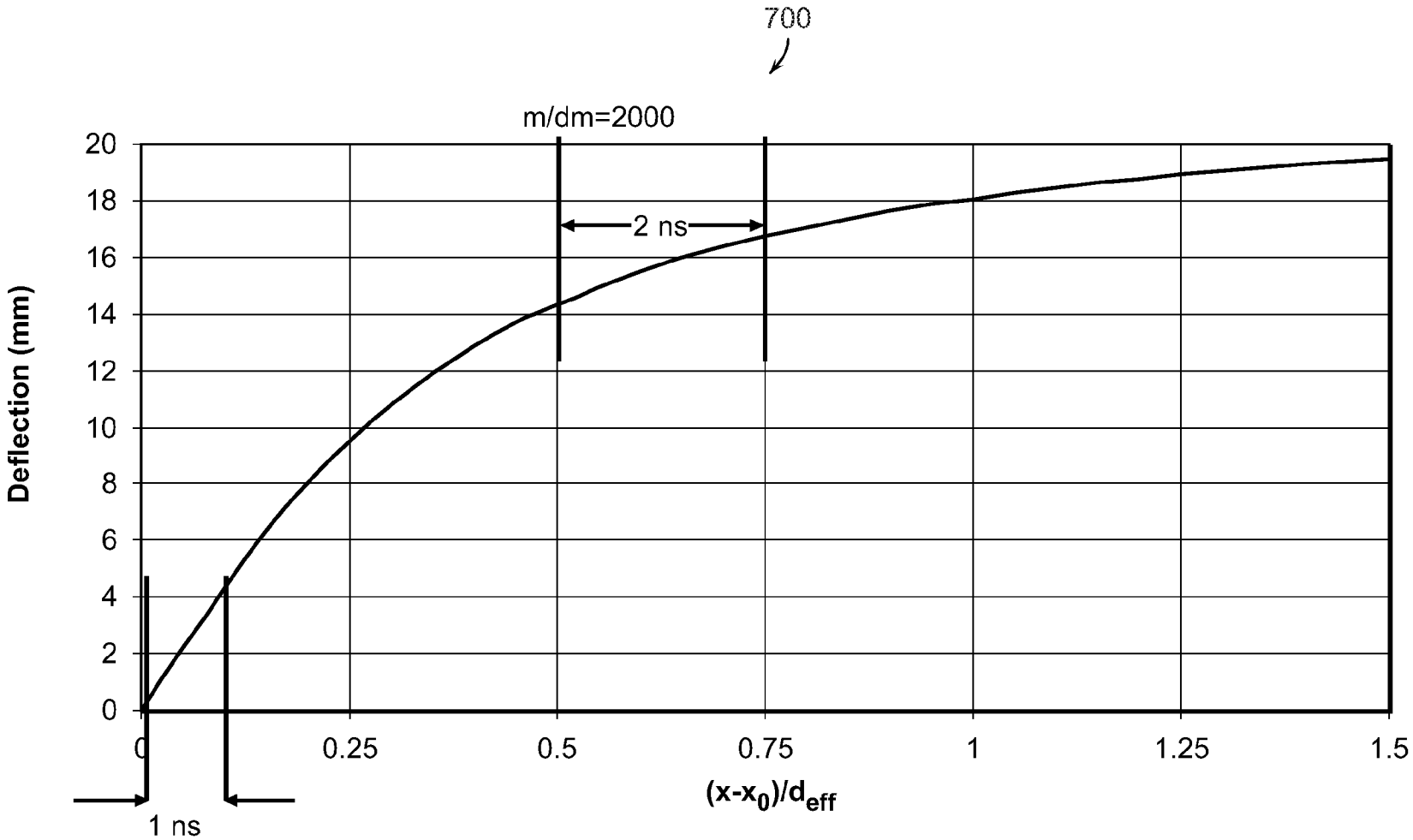
FIG. 7 presents a graph of calculated deflection distances for the first and second Bradbury-Nielsen timed ion selector in a mass spectrometer according to the present invention that is capable of precise measurements of the relative abundance of isotopes at low levels.

FIG. 7 presents a graph 700 of calculated deflection distances for the first and second Bradbury-Nielsen timed ion selector 314, 320 (FIG. 3A) in a mass spectrometer according to the present invention that is capable of precise measurements of the relative abundance of isotopes at low levels. The deflection distances were calculated using the above equations for a mass-to-charge ratio equal to 100 at $x_0$ when the polarity of the deflection voltage is switched. The calculations were performed for the parameters d=2 mm, R=0.025 mm, $V_0$=8 kV, m=100 Da, k=0.40, $d_{eff}/d$=0.721, $V_p$=200 volts, and $D_e$=2400 mm.

State-of-the-art delay generators, using the apparatus of the present invention, provide a mass resolution of about 1 ns. The maximum difference between the arrival time of a selected ion and the time that the polarity switches is about +/−1 ns. The uncertainty in the ion position during a +/−1 ns time period relative to the effective length of the deflector determines the resolving power for the ion selection. Thus, mass resolution can be improved using a lower ion velocity and a larger spacing between the wires of the Bradbury-Nielsen timed ion selector.

The graph 700 indicates the range of deflection distance for the first and second Bradbury-Nielsen timed ion selector corresponding to a 1 ns error in the switching time for the selected ion. The graph 700 also indicates the range of deflection distance for an ion differing from the selected ion by 500 ppm (2,000 resolving power). These data indicate that the resolving power is at least twice the resolving power that is required for removing the expected interferences for measurements of $^{41}CaF_3^{-1}$.

The theoretical resolving power for measuring $^{14}C$ with this Bradbury-Nielsen timed ion selector is lower by about a factor of three because the lower mass ions corresponds to a higher ion velocity, which results in lower resolution. In some embodiments, it may be necessary to decrease the accelerating voltage to satisfactorily remove potential mass interferences. At a 1 kV accelerating voltage, the theoretical resolving power for the high resolution timed ion selector at a mass-to-charge ratio of 14 is essentially the same as for a mass-to-charge ratio equal to 100 at 8 kV.

Figure 8:
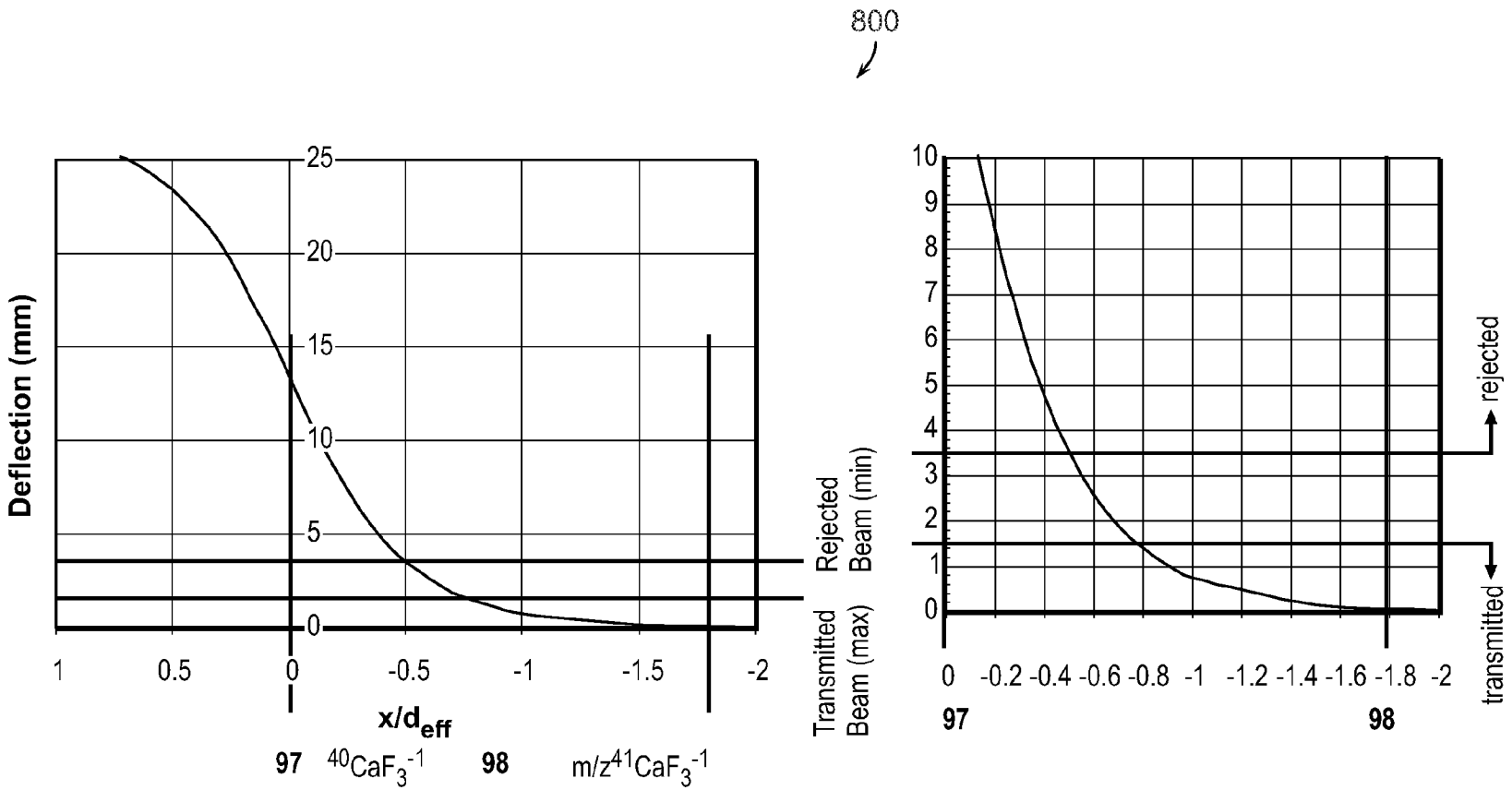
FIG. 8 presents a graph of calculated deflection distances for a Bradbury-Nielsen timed ion selector operating in the low resolution mode for ions in the mass range of $CaF_3^{-1}$ at 8 kV in a mass spectrometer according to the present invention that is capable of precise measurements of the relative abundance of isotopes at low levels.

FIG. 8 presents a graph 800 of calculated deflection distances for a Bradbury-Nielsen timed ion selector operating in the low resolution mode for ions in the mass range of $CaF_3^{-1}$ at 8 kV in a mass spectrometer according to the present invention that is capable of precise measurements of the relative abundance of isotopes at low levels. The graph 800 presents data for the wire spacing d equal 1 mm and R=0.025. For this geometry k=0.485 and $d_{eff}/d$=0.734. Other parameters used in the calculation are $V_p$=500 volts, and $D_e$=1,000 mm. If the radius of the limiting aperture is about 1.5 mm, all of the m/z 97 ions are transmitted and none of m/z 97 ions are transmitted.

The calculated deflection distances are average deflection distances in one direction. There is a corresponding second beam deflected by a similar amount in the opposite direction. The deflection distance also depends on the trajectory of the incoming ion relative to the wires in the ion selector. It is known that the total variation in deflection distance due to the initial y position is about +/−10% of the average deflection difference. Thus, for rejection of mass-to-charge ratio 97 by the low resolution gate, the rejected beam has a maximum diameter less than 4 mm and is deflected from the transmission aperture by more than 10 mm.

The performance of the mass spectrometer of the present invention is limited by the abundance sensitivity or by the ability to detect an ion in the presence of a very large number of other ions. One particularly demanding application is to measure the m/z 98 ($^{41}CaF_3^{-1}$) ion, while distinguishing the m/z 97 ($^{40}CaF_3^{-1}$) ion with less than a $10^{-15}$ contribution of the m/z 97 ion to the signal for m/z 98. If no gating were employed, the peaks from these two ions at the detector are each about 1 ns wide and separated by about 200 ns. Except for scattered ions and the fact that the high intensity beam would suppress the response for the low intensity beam, the resolving power alone would be sufficient to achieve this abundance sensitivity.

The performance of the mass spectrometer of the present invention is also limited by isobaric interferences, which are interferences from other ions at the same nominal mass. FIG. 9A illustrates a table 900 of ion masses with the same nominal mass-to-charge ratio as $^{41}CaF^+$. One significant isobaric interference is the $^{41}KF^+$ ion. Distinguishing the $^{41}KF^+$ ion would require very high resolving power (133,000), but this ion is not expected to be formed as a stable ion by laser desorption. In addition, the $NaCl^+$ ions are not expected to be generated with laser desorption. Another significant isobaric interference is the $^{28}SiO_2^+$ ion. If the $^{28}SiO_2^+$ ion is present at significant intensities, it may preclude sensitive measurements of $^{41}Ca$ using positive ions from $CaF_2$. In addition, there are other possible organic ions with this mass-to-charge ratio. However, these possible organic ions all contain several H atoms, which results in a relatively large mass compared with the mass of the $^{41}CaF^+$ ion. In practice, most of the other ions can be efficiently separated by the high-resolution precursor selector.

FIG. 9B illustrates a table 950 of ion masses with the same nominal mass-to-charge ratio as $^{41}CaF_3^-$ and $^{46}CaF_3^-$. The table 950 indicates that there appears to be no other significant elemental ion interferences. There are a number of possible organic ions at these nominal masses. However, all of these organic ions have a relatively large positive mass defect. Thus, it appears that all of the potential interferences can be effectively removed using the high-resolution selector.

FIG. 9C illustrates a table 970 of ion masses with the same nominal mass-to-charge ratio as $^{14}C^-$. The table 970 indicates that the potential interferences with $^{14}C^-$ due to stable negative ions can be readily removed using the high-resolution timed ion selector described in connection with FIG. 3. The high-resolution timed ion selector described herein provides at least 4,000 resolving power for each of the Ca isotopes at 8 kV. In addition, a factor of three resolving power improvement could be realized with a 1 kV accelerating voltage. Furthermore, the resolving power at the detector, which is on order of 20,000, further reduces the probability that any of these potential interferences will limit the performance. Sufficient resolving power for carbon can be obtained by reducing the ion energy. However, since the transmission depends only on the ratio of energy-to-mass, the performance with a 1 kV accelerating voltage for carbon is expected to be at least equal to that for Ca at 8 kV.

The performance of the mass spectrometer of the present invention is also limited by the accuracy of the ratio measurements. Using the ion counting detector described herein, the noise signal is not expected to be significant. At higher current levels where the signal is digitized, the percent standard deviation can be expressed according to Poisson statistics as $\% SD=100(N_I^{-1}+N_c^{-1})^{1/2}$, where $N_I$ is the total number of ions detected, and $N_c$ is the total number of counts recorded by the digitizer.

If an 8-bit digitizer is employed, the average signal/shot in each time bin must be limited to about 100 counts. A typical measurement may involve summing 10,000 shots yielding $10^6$ counts. The number of ions involved in generating this signal is generally very much larger than the number of counts. The measurement precision for such measurements is approximately 0.1%. Thus, for precise measurements at very low levels, a large number of laser shots is required.

The performance of the mass spectrometer of the present invention is also limited by detector calibration. Accurate measurements of isotope ratios with a mass spectrometer according to the present invention require calibration of the response of each detector channel by analyzing a known standard. Effects due to sample depletion and other potential time dependent variations, such as electron multiplier gain, can be compensated by frequently switching between measurements of the unknown and the standard. If the sample and the standard (or standards) are loaded in known locations on the sample plate, then the instrument can alternate between the sample and the standard. The ratios can be computed for each pair of measurements and accumulated as necessary to achieve the required precision.

In addition, the performance of the mass spectrometer of the present invention is limited by the overall speed of the measurement. The speed that the sample is desorbed depends on the laser fluence, laser spot size, sample thickness, sample morphology, and the number of ions produced per laser shot. For many practical applications, several thousand laser shots will be required to completely desorb a typical sample from a single laser spot. For example, a typical carbon sample may be 20 mg, which correspond to about $10^{21}$ carbon molecules. To avoid local overheating, it is often desirable to scan over the sample plate multiple times to completely desorb the sample with the laser pulses. With a laser beam diameter of 100 μm and a beam scanning rate of 10 mm/sec, the entire surface can be scanned in about 5 minutes. These conditions correspond to about 50 laser shots per laser spot diameter with a 5 kHz pulse repetition rate. If twenty-four such scans are required to desorb the entire sample, then the total measurement time is two hours for a 20 mg sample of carbon. In this example, the overall efficiency should be at least 0.001%.

Furthermore, the performance of the mass spectrometer of the present invention is limited by the overall efficiency of the measurement. The overall efficiency is determined by both the properties of the pulsed ion source 302 and the properties of the mass analyzer section of the mass spectrometer. The most significant properties of the pulsed ion source 303 that affect overall efficiency is the number of ions produced per sample molecule desorbed and the number of ions produced per laser pulse.

The overall ionization and transfer efficiency are also important parameters that determine the speed and efficiency of the mass spectrometer. For example, the overall ionization and transfer efficiency of $CaF^+$, $CaF_3^-$ and $C^-$ produced by laser desorption is at least 0.001% and can be on order of one percent. Overall ionization and transfer efficiencies on order of 1% will enable the speed, sensitivity, and dynamic range performance of the mass spectrometer of the present invention to compete favorably with accelerator mass spectrometer instruments.

Equivalents

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art, which may be made therein without departing from the spirit and scope of the teaching.

What is claimed is:

1. A mass spectrometer comprising:

a. a pulsed ion source that generates an ion beam comprising a plurality of ions;

b. a first timed ion selector that is positioned in a path of the ion beam, the first timed ion selector passing a first group of ions;

c. a first ion mirror that is positioned in a path of the first group of ions, the first ion mirror generating a reflected ion beam comprising the first group of ions that at least partially compensates for an initial kinetic energy distribution of the first group of ions;

d. a second timed ion selector that is positioned in a path of the reflected ion beam comprising the first group of ions, the second timed ion selector passing a second group of ions;

e. a second ion mirror that is positioned in a path of the second group of ions, the second ion mirror generating a reflected ion beam comprising the second group of ions that at least partially compensates for an initial kinetic energy distribution of the second group of ions;

f. a timed ion deflector that is positioned in a path of the reflected ion beam comprising the second group of ions, the timed ion deflector deflected the reflected ion beam; and g. a detector assembly comprising at least two ion detectors that is positioned in a path of the deflected ion beam, the detector assembly detecting the deflected ion beam comprising the second group of ions with the at least two ion detectors.

2. The mass spectrometer of claim 1 wherein the pulsed ion source generates an ion beam that minimizes time dispersion of ions with predetermined mass and charge at the first timed ion selector.

3. The mass spectrometer of claim 1 wherein the first ion mirror generates a reflected ion beam that minimizes time dispersion of ions with predetermined mass and charge at the second timed ion selector.

4. The mass spectrometer of claim 1 wherein the second ion mirror generates a reflected ion beam that minimizes time dispersion of ions with predetermined mass and charge at the detector.

5. The mass spectrometer of claim 1 wherein the timed ion deflector directs ions with predetermined mass and charge to a predetermined one of the at least two ion detectors in the detector assembly.

6. The mass spectrometer of claim 1 wherein at least one of the first and second timed ion selectors comprises a Bradbury-Nielson ion gate.

7. The mass spectrometer of claim 1 wherein the pulsed ion source comprises a MALDI source.

8. The mass spectrometer of claim 1 further comprising at least one baffle positioned to transmit only ions selected by the first and second ion selectors and deflected by the timed ion deflector to selected ion detectors.

9. The mass spectrometer of claim 1 further comprising an ion deflector that deflects the ion beam generated by the pulsed ion source at a predetermined angle that reduces ion trajectory errors which limit the resolving power of the mass spectrometer.

10. The mass spectrometer of claim 9 wherein the predetermined angle is about 1.5 degrees.

11. The mass spectrometer of claim 1 wherein an input to the first ion mirror is tilted at a predetermined angle relative to the direction of the ion beam in order to reduce ion trajectory errors which limit the resolving power of the mass spectrometer.

12. The mass spectrometer of claim 9 wherein the predetermined angle that the ion deflector deflects the ion beam generated by the pulsed ion source is substantially equal to a predetermined angle that the input to the first ion mirror is tilted relative to the direction of the ion beam.

13. The mass spectrometer of claim 1 wherein the detector assembly comprises a center detector and a first and second side detector.

14. The mass spectrometer of claim 13 wherein the center detector comprises a Faraday cup.

15. The mass spectrometer of claim 13 wherein at least one of the first and second side detectors comprises a discrete dynode electron multiplier.

16. The mass spectrometer of claim 1 wherein at least one of the detectors in the detector assembly comprises an entrance aperture that is shaped to allow ions deflected by the timed ion deflector to be detected by the detector.

17. The mass spectrometer of claim 1 further comprising a multi-channel delay generator that is electrically connected to a control input of the pulsed ion source and at least one of a control input of the first and second timed ion selectors, and a control input of the timed ion deflector, the multi-channel delay generator generating signals that control the timing of at least one of the first and second timed ion selectors, and the timed ion deflector relative to an initiation of the laser pulse by the pulsed ion source.

18. The mass spectrometer of claim 17 wherein the multi-channel delay generator has at least a 1 nsec precision.

19. The mass spectrometer of claim 1 wherein the first timed ion selector operates in a low resolution mode and the second timed ion selector operates in a high resolution mode.

20. The mass spectrometer of claim 1 further comprising an ion beam steering device that is positioned in a path of the reflected ion beam comprising the first group of ions.

21. A method of measuring isotope ratios, the method comprising:

a. generating an ion beam comprising a plurality of ions;

b. selecting a first group of ions from the plurality of ions with a low resolution timed ion selector;

c. selecting a second group of ions from the first group of ions with a high resolution timed ion selector;

d. deflecting ions in the second group of ions to a plurality of ion detectors; and e. detecting the deflected ions with the plurality of ion detectors.

22. The method of claim 21 further comprising passing at least one of the first and the second groups of ions through a baffle.

23. The method of claim 21 further comprising compensating for an initial kinetic energy distribution of the first group of ions.

24. The method of claim 21 further comprising compensating for an initial kinetic energy distribution of the second group of ions.

25. The method of claim 21 further comprising deflecting the ion beam generated by the pulsed ion source at a predetermined angle that reduces ion trajectory errors which limit the resolving power of the isotope ratio measurement.

26. The method of claim 21 further comprising controlling the timing of at least one of the selecting the first group of ions, selecting the second group of ions, and the deflecting the second group of ions to the plurality of detectors, wherein the timing is controlled relative to the generating the ion beam.

27. A method of measuring $^{41}Ca/^{46}Ca$ isotope ratios, the method comprising:

a. generating an ion beam comprising a plurality of $CaF_3^-$ ions from $CaF_2$ ions;

b. selecting ions with mass-to-charge ratios in the range of 98-105 corresponding to $CaF_3^-$ ions including the Ca isotopes other than $^{40}Ca$ from the plurality of ions while rejecting $^{40}CaF_3^-$ ions having a mass-to-charge ratio equal to 97;

c. selecting ions with mass-to-charge ratios equal to 97.958 corresponding to $^{41}Ca$ and with mass-to-charge ratios equal to 102.949 corresponding to $^{46}Ca$, while rejecting others ions differing in mass by more than 200 ppm from selected ions;

d. deflecting the selected ions with mass-to-charge ratios equal to 97.958 corresponding to $^{41}Ca$ to an input of a first detector and deflecting the selected ions with mass-to-charge ratios equal to 102.949 corresponding to $^{46}Ca$ to an input of a second detector; and e. detecting the ions with mass-to-charge ratios equal to 97.958 corresponding to $^{41}Ca$ with the first detector and detecting the ions with mass-to-charge ratios equal to 102.949 corresponding to $^{46}Ca$ with the second detector.

28. The method of claim 27 further comprising passing the ions with mass-to-charge ratios equal to 97.958 corresponding to $^{41}Ca$ and the ions with mass-to-charge ratios equal to 102.949 corresponding to $^{46}Ca$ ions through a baffle.

29. The method of claim 27 further comprising compensating for an initial kinetic energy distribution of ions with mass-to-charge ratios in the range of 98-105 corresponding to the Ca isotopes.

30. The method of claim 27 further comprising compensating for an initial kinetic energy distribution in the ions with mass-to-charge ratios equal to at least one of 97.958 corresponding to $^{41}Ca$ and 102.949 corresponding to $^{46}Ca$.

31. The method of claim 27 further comprising deflecting the ion beam comprising the plurality of Ca ions at a predetermined angle that reduces ion trajectory errors which limit the resolving power of the isotope ratio measurement.

32. The method of claim 27 further comprising controlling the generation of the ion beam comprising the plurality of Ca ions relative to the selecting the ions with mass-to-charge ratios in the range of 98-105 and the mass-to-charge ratios equal to 97.958 and 102.949, and relative to the deflecting the selected ions.

33. A mass spectrometer comprising:

a. a means for generating an ion beam comprising a plurality of ions;

b. a means for selecting a first group of ions from the plurality of ions;

c. a means for compensating for an initial kinetic energy distribution in the first group of ions;

d. a means for selecting a second group of ions from the first group of ions;

e. a means for compensating for an initial kinetic energy distribution in the second group of ions;

f. a means deflecting ions in the second group of ions to at least two ion detectors; and g. a means for detecting the deflected second group of ions with the at least two ion detectors.

34. The mass spectrometer of claim 33 further comprising a means for controlling the selection of the first and the second groups of ions relative to the generating the ion beam.

* * * * *